US008267712B2

(12) United States Patent
Huang et al.

(10) Patent No.: US 8,267,712 B2
(45) Date of Patent: Sep. 18, 2012

(54) RJ-45 CONNECTOR ASSEMBLY AND ASSISTING APPARATUS FOR UNPLUGGING RJ-45 CONNECTOR

(75) Inventors: Chung-Chi Huang, Tu-Cheng (TW); Guang-Dong Yuan, Shenzhen (CN); Hai-Qing Zhou, Shenzhen (CN)

(73) Assignees: Hong Fu Jin Precision Industry (ShenZhen) Co., Ltd., Shenzen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/045,521

(22) Filed: Mar. 10, 2011

(65) Prior Publication Data

US 2012/0164868 A1 Jun. 28, 2012

(30) Foreign Application Priority Data

Dec. 28, 2010 (CN) ..... 2010 1 0609111

(51) Int. Cl.
*H01R 13/627* (2006.01)

(52) U.S. Cl. ..... 439/352; 439/344

(58) Field of Classification Search ..... 439/344, 439/352, 350, 353, 354, 357, 358
See application file for complete search history.

(56) References Cited

U.S. PATENT DOCUMENTS 5,462,457 A * 10/1995 Schroepfer et al. ..... 439/736
6,017,153 A * 1/2000 Carlisle et al. ..... 385/56
6,024,498 A * 2/2000 Carlisle et al. ..... 385/56
6,080,001 A * 6/2000 Wong ..... 439/344
6,174,190 B1 * 1/2001 Tharp et al. ..... 439/352
6,196,733 B1 * 3/2001 Wild ..... 385/86
6,254,418 B1 * 7/2001 Tharp et al. ..... 439/352
6,322,386 B1 * 11/2001 Tharp et al. ..... 439/344
D466,479 S * 12/2002 Pein et al. ..... D13/147
6,565,262 B2 * 5/2003 Childers et al. ..... 385/76
6,752,538 B1 * 6/2004 Bates, III ..... 385/78
6,789,954 B2 * 9/2004 Lampert et al. ..... 385/78
6,799,898 B2 * 10/2004 Cheng et al. ..... 385/56
6,863,556 B2 * 3/2005 Viklund et al. ..... 439/354
6,866,532 B1 * 3/2005 Huang ..... 439/344
7,101,212 B1 * 9/2006 Larkin ..... 439/344
7,281,859 B2 * 10/2007 Mudd et al. ..... 385/76
7,297,013 B2 * 11/2007 Caveney et al. ..... 439/352
7,325,980 B2 * 2/2008 Pepe ..... 385/86
7,326,075 B1 * 2/2008 Armstrong et al. ..... 439/354
7,329,137 B2 * 2/2008 Martin et al. ..... 439/344
7,431,604 B2 * 10/2008 Waters et al. ..... 439/344
7,435,126 B1 * 10/2008 Larkin ..... 439/352
7,465,180 B2 * 12/2008 Kusuda et al. ..... 439/352
7,540,756 B1 * 6/2009 Strahl ..... 439/354
7,549,888 B1 * 6/2009 Armstrong et al. ..... 439/354
7,555,192 B2 * 6/2009 Ishii et al. ..... 385/137
7,578,692 B2 * 8/2009 Kaneda ..... 439/352

(Continued)

*Primary Examiner* — Ross Gushi
(74) *Attorney, Agent, or Firm* — Altis Law Group, Inc.

(57) ABSTRACT

A Registered Jack-45 (RJ-45) connector assembly includes an RJ-45 connector, and an assisting apparatus for unplugging the RJ-45 connector. The RJ-45 connector includes a slanted resilient latch. The assisting apparatus includes a latching portion and a pressable portion. A receiving slot is defined in the front end of the latching portion, to engage with the resilient latch of the RJ-45 connector. When the pressable portion is pressed, the assisting apparatus drives the resilient latch of the RJ-45 connector to deform and disengage from a connector of an electronic device.

10 Claims, 4 Drawing Sheets

U.S. PATENT DOCUMENTS

| | | | | |
|---|---|---|---|---|
| 7,651,361 | B2 * | 1/2010 | Henry et al. | 439/352 |
| 7,686,638 | B2 * | 3/2010 | Boyd et al. | 439/344 |
| 7,695,198 | B1 * | 4/2010 | Baechtle et al. | 385/69 |
| 7,704,091 | B2 * | 4/2010 | Millan | 439/344 |
| 7,708,581 | B2 * | 5/2010 | Weiss | 439/344 |
| RE41,933 | E * | 11/2010 | Cheng et al. | 385/56 |
| 7,824,205 | B2 * | 11/2010 | Scislak | 439/344 |
| 7,959,455 | B1 * | 6/2011 | Armstrong et al. | 439/354 |
| 8,025,519 | B2 * | 9/2011 | Handshaw et al. | 439/352 |
| 2004/0101254 | A1 * | 5/2004 | Erdman et al. | 385/78 |
| 2004/0134061 | A1 * | 7/2004 | Kuiken et al. | 29/854 |
| 2005/0054230 | A1 * | 3/2005 | Huang | 439/344 |
| 2005/0084215 | A1 * | 4/2005 | Grzegorzewska et al. | 385/60 |
| 2005/0106918 | A1 * | 5/2005 | Colantuono et al. | 439/290 |
| 2006/0115219 | A1 * | 6/2006 | Mudd et al. | 385/62 |
| 2006/0199414 | A1 * | 9/2006 | Larkin | 439/344 |
| 2007/0077806 | A1 * | 4/2007 | Martin et al. | 439/344 |
| 2008/0268696 | A1 * | 10/2008 | Boyd et al. | 439/354 |
| 2009/0042424 | A1 * | 2/2009 | Kaneda | 439/159 |
| 2010/0003844 | A1 * | 1/2010 | Chen et al. | 439/350 |
| 2011/0111617 | A1 * | 5/2011 | Handshaw et al. | 439/352 |
| 2011/0237111 | A1 * | 9/2011 | Liu et al. | 439/354 |
| 2011/0318949 | A1 * | 12/2011 | Adams | 439/304 |

* cited by examiner

RJ-45 CONNECTOR ASSEMBLY AND ASSISTING APPARATUS FOR UNPLUGGING RJ-45 CONNECTOR

BACKGROUND

1. Technical Field

The present disclosure relates to a Registered Jack-45 (RJ-45) connector assembly, and an assisting apparatus for unplugging an RJ-45 connector.

2. Description of Related Art

Registered Jack-45 (RJ-45) connectors are widely used in network communication. However, unplugging an RJ-45 connector manually from a connector of an electronic device can be difficult and inconvenient because of limited or cramped operation space.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
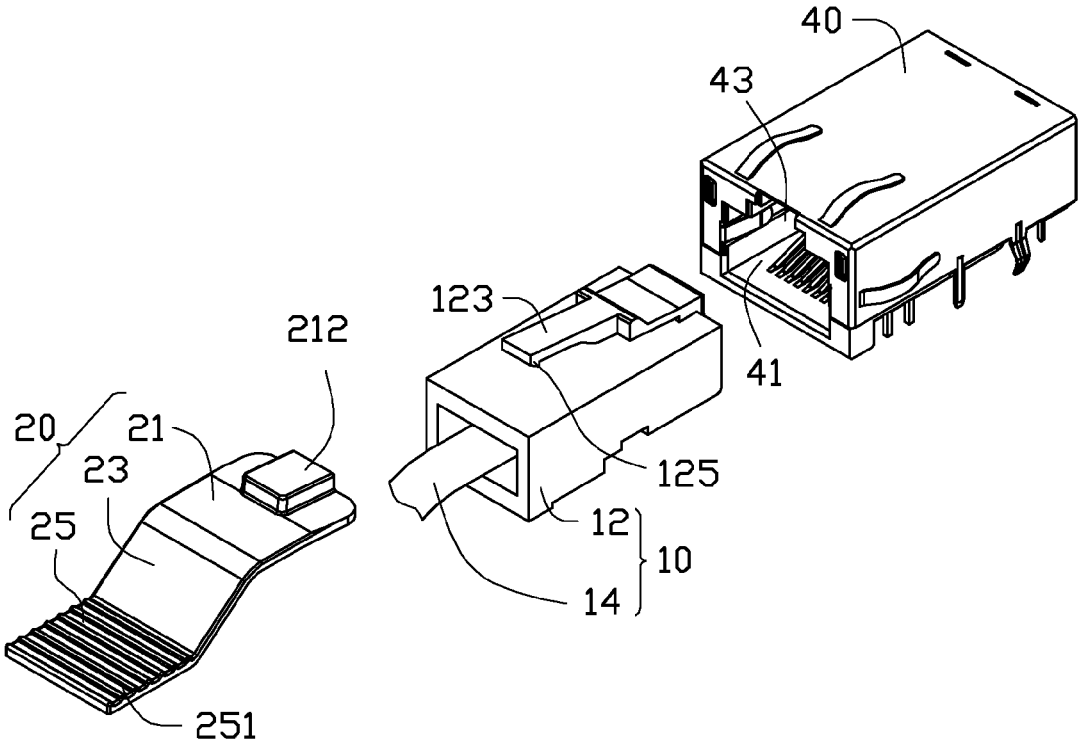
FIG. 1 is an exploded, isometric view of an embodiment of a Registered Jack-45 (RJ-45) connector assembly together with a connector, the RJ-45 connector assembly including an assisting apparatus.
Figure 2:
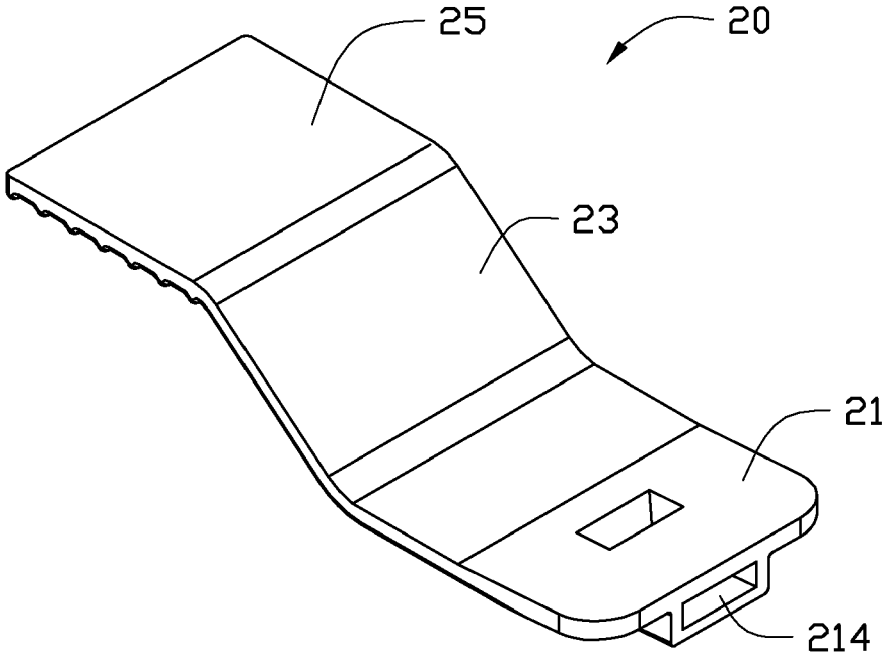
FIG. 2 is an enlarged, inverted view of the assisting apparatus of FIG. 1.

Referring to FIGS. 1 and 2, an embodiment of a Registered Jack-45 (RJ-45) connector assembly includes an RJ-45 connector 10, and an assisting apparatus 20.

The RJ-45 connector 10 includes a main body 12, and a cable 14 connected to the rear end of the main body 12. A resilient latch 123 extends up and back from the front end of the top of the main body 12. A hooking portion 125 extends down from the rear end of the resilient latch 123.

The assisting apparatus 20 includes a latching portion 21, a connection portion 23 slantingly extending down from the rear end of the latching portion 21, and a pressable portion 25 extending from the rear end of the connection portion 23. The pressable portion 25 is substantially parallel to the latching portion 21. A receiving portion 212 protrudes from the front end of the top of the latching portion 21. A substantially L-shaped receiving slot 214 having an inside corner is defined in the receiving portion 212, with a first end of the receiving slot 214 extending through the front end of the receiving portion 212, and a second end of the receiving slot 214 extending through a bottom of the latching portion 21. A plurality of skid-resistant protrusions 251 is formed on the top of the pressable portion 25.

The RJ-45 connector 10 can be electrically connected to a connector 40 of an electronic device. An opening 41 is defined in the rear end of the connector 40, and a latching slot 43 is defined in the rear end of the connector 40 communicating with the top of the opening 41.

Figure 3:
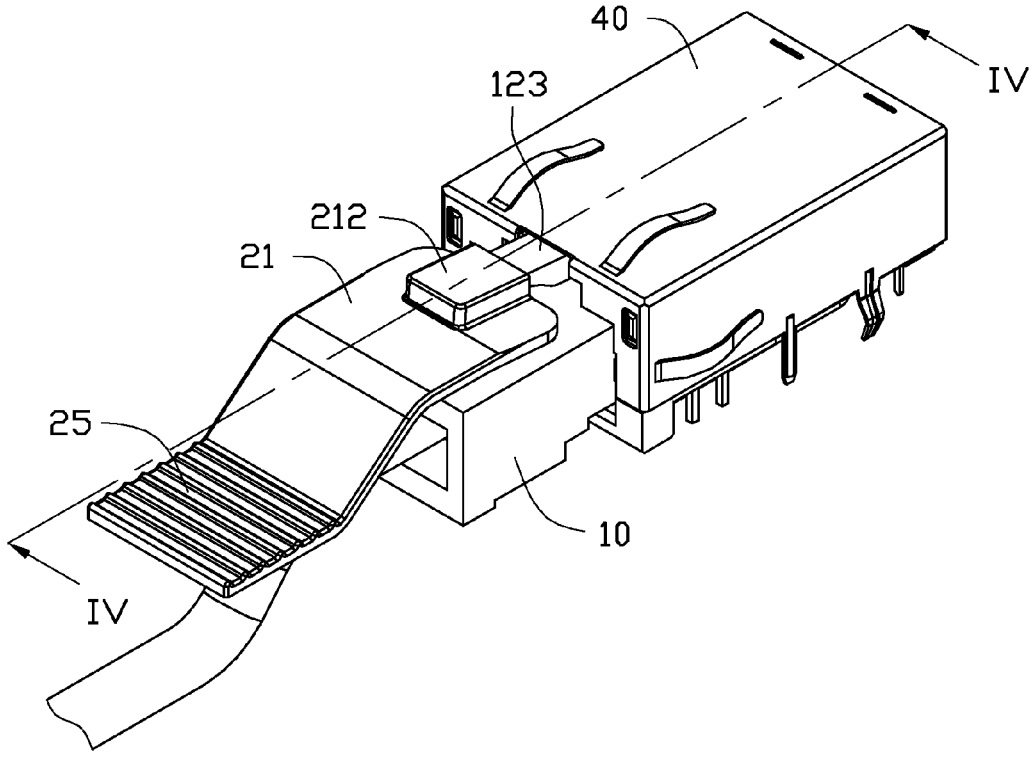
FIG. 3 is an assembled, isometric view of FIG. 1.
Figure 4:
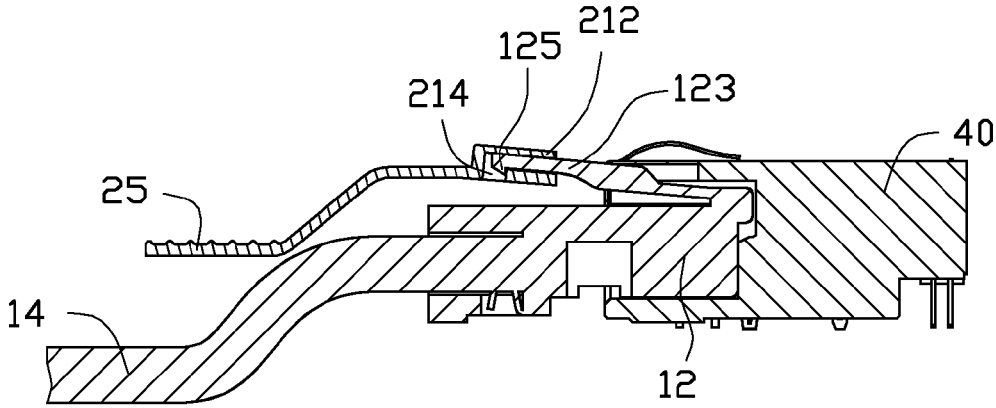
FIG. 4 is a cross-sectional view taken along the line IV-IV of FIG. 3.

Referring to FIGS. 3 and 4, to electrically connect the RJ-45 connector 10 to the connector 40, the front end of the RJ-45 connector 10 is inserted into the opening 41 of the connector 40. The front end of the resilient latch 123 of the RJ-45 connector 10 engages with the latching slot 43 of the connector 40. Thereby, the RJ-45 connector 10 is electrically connected to the connector 40.

To unplug the RJ-45 connector 10 from the connector 40, the rear end of the resilient latch 123 of the RJ-45 connector 10 is inserted into the receiving slot 214 of the receiving portion 212 of the assisting apparatus 20 from the first end of the receiving slot 214. The hooking portion 125 of the resilient latch 123 engages with the inside corner of the receiving slot 214. Thereby, the RJ-45 connector 10 is connected to the assisting apparatus 20. The pressable portion 25 of the assisting apparatus 20 is pressed down, to drive the resilient latch 123 to deform downwards and disengage from the latching slot 43 of the connector 40. Therefore, the RJ-45 connector 10 can be directly unplugged from the connector 40.

In this embodiment, the operation distance of the resilient latch 123 of the RJ-45 connector 10 is increased by using the assisting apparatus 20, therefore, unplugging the RJ-45 connector 10 becomes easy.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A Registered Jack-45 (RJ-45) connector assembly, comprising:

an RJ-45 connector comprising a main body, and a resilient latch extending up and back from the front end of the top of the main body; and an assisting apparatus for unplugging the RJ-45 connector, the assisting apparatus comprising a latching portion, a connection portion slantingly extending down from a rear end of the latching portion, and a pressable portion extending rearward from a rear end of the connection portion, wherein a receiving slot is defined in the front end of the latching portion, to engage with the resilient latch of the RJ-45 connector, a rear end of the pressable portion is cantilevered, when the rear end of the pressable portion is pressed down, the assisting apparatus drives the resilient latch of the RJ-45 connector to deform downward.

2. The RJ-45 connector assembly of claim 1, wherein the pressable portion is substantially parallel to the latching portion.

3. The RJ-45 connector assembly of claim 1, wherein a hooking portion protrudes from the rear end of the resilient latch, the receiving slot of the assisting apparatus is substantially L-shaped and comprises an inside corner, when the resilient latch of the RJ-45 connector is inserted into the receiving slot of the assisting apparatus, the hooking portion of the resilient latch engages with the corner of the receiving slot.

4. The RJ-45 connector assembly of claim 3, wherein a receiving portion protrudes from the front end of the top of the latching portion, the receiving slot is defined in the receiving portion and extends through the front end of the receiving portion and the bottom of the latching portion.

5. The RJ-45 connector assembly of claim 3, wherein a plurality of skid-resistant protrusions is formed on the top of the pressable portion.

6. A Registered Jack-45 (RJ-45) connector assembly, comprising:

an RJ-45 connector comprising a main body, and a resilient latch extending up and back from the front end of the top of the main body; and an assisting apparatus for unplugging the RJ-45 connector, the assisting apparatus comprising a latching portion and a pressable portion, wherein a receiving slot is defined in the front end of the latching portion, to engage with the resilient latch of the RJ-45 connector, when the pressable portion is pressed, the assisting apparatus drives the resilient latch of the RJ-45 connector to deform, a hooking portion protrudes from the rear end of the resilient latch, the receiving slot of the assisting apparatus is substantially L-shaped and comprises an inside corner, when the resilient latch of the RJ-45 connector is inserted into the receiving slot of the assisting apparatus, the hooking portion of the resilient latch engages with the corner of the receiving slot.

7. The RJ-45 connector assembly of claim 6, further comprising a connection portion slantingly extending from the rear end of the latching portion, wherein the pressable portion extends from the rear end of the connection portion.

8. The RJ-45 connector assembly of claim 7, wherein the pressable portion is substantially parallel to the latching portion.

9. The RJ-45 connector assembly of claim 6, wherein a receiving portion protrudes from the front end of the top of the latching portion, the receiving slot is defined in the receiving portion and extends through the front end of the receiving portion and the bottom of the latching portion.

10. The RJ-45 connector assembly of claim 6, wherein a plurality of skid-resistant protrusions is formed on the top of the pressable portion.

* * * * *